US007559665B1

(12) United States Patent
Pfanstiehl

(10) Patent No.: US 7,559,665 B1
(45) Date of Patent: Jul. 14, 2009

(54) LOW COST AUTOMATICALLY ILLUMINATED DOCUMENT HOLDER

(76) Inventor: John Pfanstiehl, 448 Harbor Dr. S., Indian Rocks Beach, FL (US) 33785

( * ) Notice: Subject to any disclaimer, the term of this patent is extended or adjusted under 35 U.S.C. 154(b) by 32 days.

(21) Appl. No.: 11/962,813

(22) Filed: Dec. 21, 2007

(51) Int. Cl.
*F21V 33/00* (2006.01)

(52) U.S. Cl. ..... 362/99; 362/276; 362/802; 40/124.02

(58) Field of Classification Search ..... 362/98, 362/99, 276, 802; 40/124.02, 442
See application file for complete search history.

(56) References Cited

U.S. PATENT DOCUMENTS

| | | | | |
|---|---|---|---|---|
| 4,209,824 | A | 6/1980 | Kaufman | |
| 4,286,399 | A | 9/1981 | Funahashi et al. | |
| 4,290,093 | A | 9/1981 | Thompson et al. | |
| 4,363,081 | A | 12/1982 | Wilbur | |
| 4,497,126 | A * | 2/1985 | Dejean | 40/124.02 |
| 5,355,115 | A | 10/1994 | Goor et al. | |
| 5,610,770 | A | 3/1997 | Galiani | |
| 5,639,156 | A | 6/1997 | Broxson | |
| 5,813,748 | A | 9/1998 | Maxymych | |
| 6,023,377 | A | 2/2000 | Slager | |
| 6,050,214 | A | 4/2000 | OKeefe | |
| 6,257,621 | B1 | 7/2001 | Smith | |
| 6,409,357 | B1 | 6/2002 | Thompson et al. | |
| 6,409,360 | B2 | 6/2002 | Contant et al. | |
| 6,637,907 | B1 | 10/2003 | Levy | |
| 6,796,673 | B1 | 9/2004 | Dempsey et al. | |
| 6,808,208 | B2 | 10/2004 | Ward | |
| 7,128,433 | B2 | 10/2006 | Schlosser | |
| 7,163,307 | B1 | 1/2007 | Clark et al. | |

* cited by examiner

*Primary Examiner*—Stephen F Husar
(74) *Attorney, Agent, or Firm*—Fraser Clemens Martin & Miller LLC; Jacob M. Ward

(57) ABSTRACT

A low cost document holder automatically illuminates a document under low light conditions. An energy-saving system having a switch that turns on a lamp when a front cover is at an angle to a rear cover of between 45 and 135 degrees. The lamp is turned off when the angle is less than 45 degrees or greater than 135 degrees to prevent battery drain when the holder is left open or cannot completely close. Optimized lamp positioning places a centerline of a cone of illumination at a maximum of thirty degrees from the front cover to enable use of a low wattage lamp. The resultant low battery drain enables the components to be permanently enclosed in a document holder cover that has the appearance, dimensions and thickness of standard document holders. Advantages of components enclosed within a cover are reliability, ease of cleaning, market entry and low cost manufacture.

19 Claims, 5 Drawing Sheets

LOW COST AUTOMATICALLY ILLUMINATED DOCUMENT HOLDER

FIELD OF THE INVENTION

The present invention relates to document holders that illuminate a bill or menu delivered to a customer.

BACKGROUND OF THE INVENTION

Numerous inventions have combined a source of illumination or other elements with a document holder for various purposes:

U.S. Pat. No. 4,290,093 to Thompson, et al. (1981) discloses a portable illuminated magazine case that incorporates a switch for actuation upon opening and closing of the cover and a hood to hide the illuminating means from normal direct viewing.

U.S. Pat. No. 6,409,360 to Contant, et al. (2002) discloses a metro card holder, with map, light and clock.

U.S. Pat. No. 4,209,824 to Kaufman (1980) discloses an electrically illuminated book.

U.S. Pat. No. 5,813,748 to Maxymych (1998) discloses a relatively complex illuminated transaction tray with compartments, windows and backlighting.

U.S. Pat. No. 6,257,621 to Smith (2001) discloses a kit and assembly for organizing, viewing and locating photographs that may include a camera, a recorder, a digital organizer, a pen or pens, a mounting device, a magnifying sheet, scissors and/or a stamp pad or the like.

U.S. Pat. No. 6,023,377 to Slager (2000) discloses an aid for reading indicia, such as that printed on golf scorecards and protecting the scorecard from inclement weather. It also includes a magnifying lens.

U.S. Pat. No. 5,610,770 to Galiani (1997) discloses a lens magnification system for booklets, such as restaurant menus, for persons having impaired vision or persons in an environment of poor light.

U.S. Pat. No. 6,796,673 to Dempsey, et al. (2004) discloses a restaurant billfold with an illuminated signaling beacon for signaling a server.

U.S. Pat. No. 6,050,214 to OKeefe (2000) discloses an apparatus for indicating a patron's status in a restaurant, the apparatus comprising one or more color-coded subsections on a device to communicate a particular message to the waiter.

U.S. Pat. No. 5,355,115 to Goor et al. (1994) discloses a payment folder having a signal device for communicating to a server a patron's readiness and urgency to pay. In one embodiment, the signal device includes at least one battery powered light, such as a light emitting diode.

U.S. Pat. No. 4,363,081 to Wilbur (1982) discloses illuminated greeting cards that have LED's turned on by a slide switch which is formed by a pair of conductive foil areas on the printed circuit board and a conductive shoeing member is attached to the tab. As the card is opened, the tab translates behind the display panel and the shorting member wipes across the pair of foil areas, to complete the circuit between the battery and lamps, to turn on the LED's.

U.S. Pat. No. 4,286,399 to Funahashi, et al. (1981) discloses a card or book involving luminescence that is provided with at least one light-emitting diode, a thin battery for lighting the diode and a switch assembly comprising a slide plate which has one end attached to the inner surface of the other leaf. On opening the leaves, the diode emits light, which is extinguished when the leaves are closed to provide an indication of unique interest.

U.S. Pat. No. 5,639,156 to Broxson (1997) discloses a portable illumination device for reading material. This illumination device is operable upon the opening of its book-like folded covers and upon the tilting of the device to a pre-set angle or greater.

The previously listed inventions strive to satisfy specific needs but none disclose a low cost automatically illuminated document holder. The following inventions disclose illuminated document holders but either are not automatically illuminated, are not of a design that can be manufactured at low cost, or have other serious deficiencies.

U.S. Pat. No. 7,163,307 to Clark, et al. (2007) discloses an illuminated document caddy that can include a hood to limit the arc of light projecting from the light source and a lens to alter light emitted from the light source. Additionally, the luminous intensity of the light source may be selectively adjustable, and a magnifier, magnetic clasps, and removable components including a housing cover and a colored lens may be included. There are many deficiencies in this prior art. The illumination stays on when the bill holder is left open, needlessly draining the battery. The illumination stays on when the bill holder is not fully closed, for example when a waiter's pen is left inside when the holder is folded as commonly occurs. The illumination stays on when not needed whenever the bill holder is opened in an area with sufficient ambient lighting. When the light source is on the same surface as the bill as shown in this prior art's FIG. 3, the bill is very poorly illuminated or a very high intensity light source is needed. The light source, signaling lamps, switches and magnifying member create surfaces and corners that are time consuming to thoroughly clean and that trap dirt and food in numerous places. Manufacturing costs are increased due to a number of elements including a hood, magnifier, magnetic clasp, removable lens, removable housing cover and variable resistor. Not only is this prior art much more expensive to manufacture than standard bill holders, it is substantially thicker and therefore takes up more space; fewer can be stacked in a convenient location as is common practice in restaurants. The plurality of removable components creates more work or trouble for the restaurant as they can come loose or be removed by curious or mischievous patrons.

U.S. Pat. No. 7,128,433 to Schlosser (2006) discloses a guest check presenter comprised of a magnifying sheet, light-emitting device, a calculator, a mirror and signaling lights. There are numerous problems with this prior art. The bill holder is not auto-on; the user needs to manually turn on the switch for the illumination. The switch can be left on, draining the batteries and requiring frequent replacement. The light source has to shine through a magnifying member to illuminate the bill and then the diminished light needs to be reflected back through the magnifying member to the user's eyes. This seriously diminishes the illumination or requires a very strong light source.

U.S. Pat. No. 6,808,208 to Ward (2004) discloses a food/drink tab/check holder having a magnifying member movably received in two elongate slots and a light-emitting assembly Numerous problems exist with this prior art. The elongate light-emitting member shines light into the eyes of the user and nearby patrons. The elongate light-emitting member is located at a shallow angle to the bill and therefore the bill is very poorly illuminated or a very high intensity light source is needed. Illumination stays on when not needed, prematurely draining the battery.

U.S. Pat. No. 6,637,907 to Levy (2003) discloses LED illumination for a restaurant menu that is turned on when the user grips the menu in a certain area that closes a switch located there. Numerous problems exist with this prior art. The disclosed switch requires very little pressure because people don't grip a menu with much force. Therefore the light source can be turned on even when the menu is closed due to pressure from other menus stacked upon it. Illumination can stay on when the bill holder is left open due to weight from a plate or other item placed upon it. Illumination stays on when not needed whenever the bill holder is held open in an area with sufficient ambient lighting.

U.S. Pat. No. 6,409,357 to Thompson, et al. (2002) discloses an illuminated billfold, portfolio, book and the like wherein a page of printed information contained between the front and back covers is automatically illuminated when the covers are folded away from one another. The source of illumination is affixed to at least one of the covers, while the other cover includes a notch to overlie the light source when the covers are folded closed, thereby retaining the page substantially flat. Numerous problems exist with this prior art. The illumination stays on when the bill holder is left open, when the bill holder is not fully closed, and when not needed. The light source is on the same cover surface as the bill and therefore the bill is very poorly illuminated or a very high intensity light source is needed. These all contribute to short battery life. The light source is affixed onto a surface and therefore is harder to clean and traps dirt/food in corners. Manufacturing costs are increased due to a number of elements including notches formed in the covers, cooperating means located on two covers that must register, and a position sensor.

The quantity and diversity of the art in the field of illuminated bill holders shows that many people have recognized the need for an improved bill holder and have been striving to invent a practical means to satisfy the need. However none of the listed prior art has successfully met the need in the marketplace. A primary reason for the lack of success of the prior art is that the vast majority of the many millions of bill holders in use today are very inexpensive to produce. A primary means of distribution for bill holders is that of being provided free by credit card companies, with their card name on it, to restaurants or other retail establishments. The card companies desire to have their card's name in front of the customer at time of a purchase. The present invention overcomes the deficiencies of the prior art by providing an effective automatic illuminated bill holder at such a low cost of manufacture that it can be competitive with the non-illuminated bill holder that is in widespread use.

SUMMARY OF THE INVENTION

The present invention is a document holder, such as a bill holder or a menu holder. An object of present invention is an energy-saving system that significantly decreases the amount of battery drain of an auto-on illuminated document holder in daily use. This is critical for a low cost bill holder because an illuminated bill holder that has a sufficiently low daily battery drain can work for years, which is comparable to the average service life of a standard bill holder, and therefore doesn't require that the battery or bulb be replaceable. The present invention's energy-saving system provides three cost saving advantages:

a) elimination of the additional cost of making a power supply with removable cover and compartment for replaceable batteries;

b) elimination of the need for a socket and means for replacing a bulb; and c) elimination of the need for access means for getting to a battery, power supply or bulb. Standard bill holders typically have an inexpensive stitched or induction sealed seam running along the outer edge. Adding recloseable flaps or compartments with the required zippers, Velcro, snaps, or other closure means increases production and material costs. The object of the present invention is to require none of these so that it can be made using just the standard stitching or sealing.

The object of the present invention's energy-saving system also includes two additional advantages for the restaurant:

d) increased reliability because batteries or bulbs that become loose or have problems with their electrical contacts are avoided; and e) elimination of problems from customers lifting flaps or removing covers to inspect or dissect the illumination system; it is completely and permanently enclosed in the present invention.

Prior art discloses an illuminated bill holder in which the illumination occurs automatically when the bill holder is opened. Three critical problems exist with the auto-on prior art. The object of the present invention is to eliminate these problems by:

f) preventing the light from remaining on when the bill holder is left open on the table (that time period can be ten minutes or more per transaction); and g) preventing the light from remaining on unnecessarily when the bill holder is used during good light conditions or when the customer doesn't need more illumination (that can be more than ninety percent of transactions) and, h) preventing the light from remaining on when the bill holder is closed with a pen between the covers, which frequently occurs. The battery saving system of the present invention overcomes all of these critical problems thereby:

i) providing a system that has a daily battery drain ten to a hundred times less than auto-on prior art.

The present invention's energy-saving system is comprised of a switch that only provides illumination when the bill holder is opened sufficiently to permit reading of the bill, It also turns off the illumination when the folder is opened so wide that the cone of illumination is no longer effectively on the bill. The present invention turns the illumination off when bill holder is left open on the table and when the bill holder is held fully open or nearly fully open. When ambient lighting is sufficient, customers typically read and sign the bill with the bill holder fully open or nearly fully open. In poor lighting conditions, the customer sees the illumination turn on when the front cover is opened sufficiently and the customer only holds the front cover in this range when illumination of the bill is desired. Thereby a further object of the invention is achieved:

j) operation that is self evident upon the first use and therefore requires no instruction, directions, markings or labels.

An additional energy saving feature of the present invention is an optimized lamp positioning that enables a low wattage lamp such as a LED to be used and thereby further increases battery life. The optimized lamp positioning has four objectives:

k) positioning the lamp on the front cover to face the rear cover and the bill, enabling illumination at an angle of incidence closer to ninety degrees; and l) positioning the lamp as close to the outer edge of the front cover to also enable illumination at an angle of incidence closer to ninety degrees; and m) positioning the lamp below the midpoint of the cover to enable the lamp to be as close as possible to the area that typically needs to be illuminated (the area that needs to be illuminated is the lower sixty percent of the rear cover because bills are shorter than the bill holder, bills are tucked into the bottom recess of the bill holder and the portion of the bill that requires reading or signing is not located at the top of the bill), and n) positioning the lamp so that the center of its cone of illumination is a maximum of 30 degrees from the surface of the front cover.

An important additional advantage of the present invention is that it does not permit light to shine directly in the eyes of nearby customers, either while the customer is examining the bill with illumination or when the bill holder is left open on a table. The prior art discloses hoods or lens to reduce the problem of harsh light shining into the eyes of nearby customers. Not only do these added components increase the cost and complexity of a bill holder, they are not fully effective at solving the problem. The present invention solves the problem by the combination of an energy-saving system and an optimized lamp positioning. Therefore an object of the present invention is:

o) to restrict the harsh direct illumination to the area of the bill and prevent it from reaching the eyes of the user or nearby customers.

The present invention has important commercial advantages of over the prior art. The appearance of the present invention is identical to the standard bill holder with the exception of a small flush-mounted LED located on the inside cover. No power supplies or lamp housings are affixed onto the surfaces of the bill holder. There are no visible switch buttons nor are there any switches to locate and press. The look of the present invention is clean and clutter free. Objects of the present invention are:

p) to appear as similar as possible to standard bill holders to promote acceptance and to be easily integrated with existing bill holders in a restaurant; and q) to be of similar dimensions as standard bill holders to fit into the existing distribution system; and r) to be of similar thickness as standard bill holders to fold flat as they do and thereby be easily stacked when not in use as is the common practice, and not take up more room than the standard bill holder; and s) to be free of external or surface mounted devices to be as easy to clean as the standard bill holder. This is of critical importance for an item that is handled daily in a public eating area.

Further advantages of the present invention relate to lowering manufacturing cost. Further objects of the present invention are:

t) to have all its components embedded inside the standard padded bill holder and thereby have no need for notches or other additions to accommodate the height of components; and u) to eliminate the need for molds or other expensive tooling for housings, hoods, lens, and externally mounted lamp assembles.

The present invention overcomes all the primary disadvantages of the prior art devices and methods. The primary object of this invention is to produce an effective low-cost automatically-illuminated bill holder. The novel system of this invention has an energy-saving system and an optimized lamp positioning that reduces battery drain to the extent that replacement of batteries and bulbs is not required. Therefore the bill holder can be manufactured without the extra costs of compartments, housings, covers or flaps and clasps required for battery or bulb replacement. The novel system of this invention furthermore permits all of the components to be positioned inside the covers of a standard padded bill holder. This further decreases cost of manufacture.

Another specific object of the invention is to make a bill holder that appears very similar to the standard bill holder to aid its introduction into the marketplace. The novel system of this invention, by permitting all of the components to be positioned inside the covers of a standard padded bill holder, makes it more appealing to the marketplace for several reasons. The present invention enables an illuminated bill holder to be the same dimensions and thickness as a standard padded bill holder. This facilitates integration into the current bill holder distribution system. By dimensionally matching existing bill holder inventory, the present invention facilitates integration into restaurants. The present invention folds completely flat and therefore can be stacked for storage in the same manner as standard bill holders and can even be mixed in with them. Positioning the components inside the covers provides the important added advantage of being much easier to wipe clean than a bill holder that has lamp housings, power supplies or other components surface mounted. Eliminating replaceable batteries and bulbs makes the system more reliable and tamper-proof and therefore less work for restaurant workers.

Another specific object of the invention is to make a bill holder that does not shine harsh direct light into the eyes of the user or other customers. The present invention solves the problem by the energy-saving system and the optimized lamp positioning. These combine to restrict illumination to a specific range of opening of the bill holder and further restrict the direct illumination to the surface area of the bill.

These improvements would not be obvious in view of the previous prior art taken as a whole to one of ordinary skill in this art.

The invention accordingly comprises the features of construction, combination of element and arrangement of parts that will be exemplified in the construction hereinafter set forth, and the scope of the invention will be indicated in the claims.

BRIEF DESCRIPTION OF THE DRAWINGS

For a fuller understanding of the nature and the objects of the invention, reference should be made to the following detailed description, taken with the accompanying drawings, in which.

DETAILED DESCRIPTION OF EXEMPLARY EMBODIMENTS OF THE INVENTION

Figure 1:
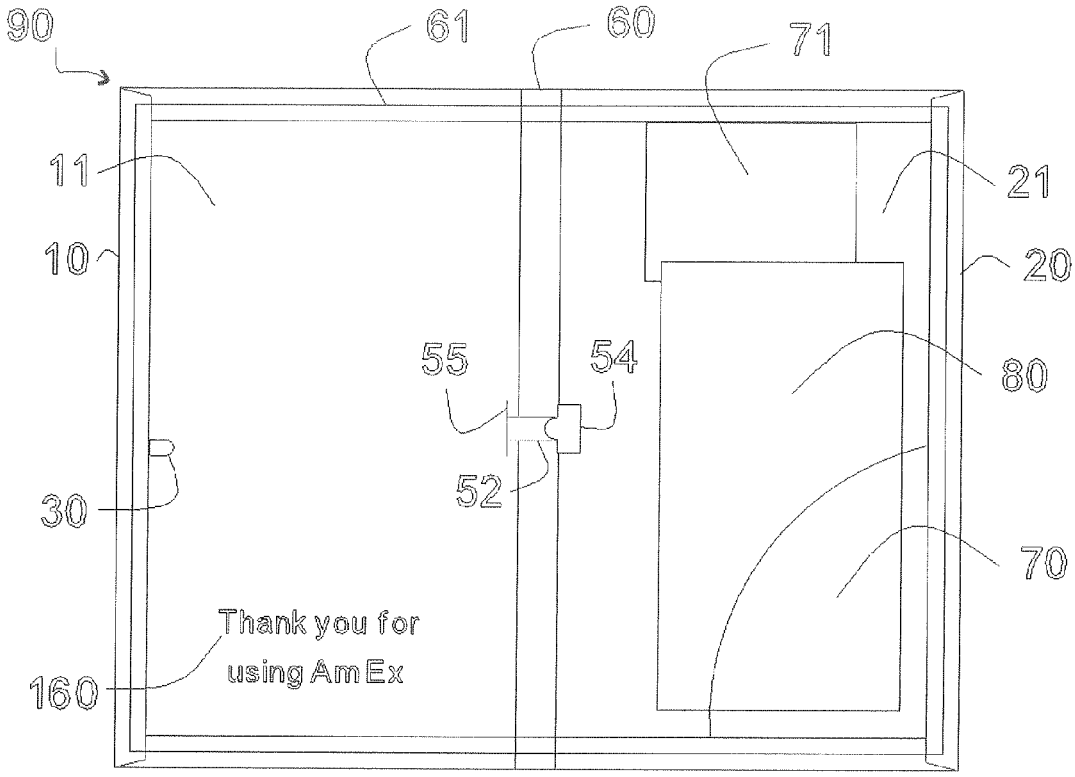
FIG. 1 is a top elevational view of a bill holder in the open position.

In a first preferred embodiment of the document holder, FIG. 1 illustrates an inside surface 11 of a front cover 10 and an inside surface 21 of a rear cover 20 of a Low Cost Automatically Illuminated Document Holder 90 of the present invention. A lamp 30 is a LED that is substantially flush-mounted to surface 11. A switch insulator strip 52 is connected to an insulator mount 54. Strip 52 and mount 54 are shown in a position above the inside cover surfaces but they can also be positioned underneath these surfaces out of view.

Other components common to standard bill holders are a cover hinge 60, a cover seam 61, a bill pocket material 70, a credit card pocket material 71 and a bill 80. Pocket materials are typically transparent flexible plastic. The preferred embodiment of the present invention intentionally makes its appearance and dimensions as close as possible to standard bill holders. Indicia 160 can advertise a credit car, a restaurant, or a product.

Figure 2:
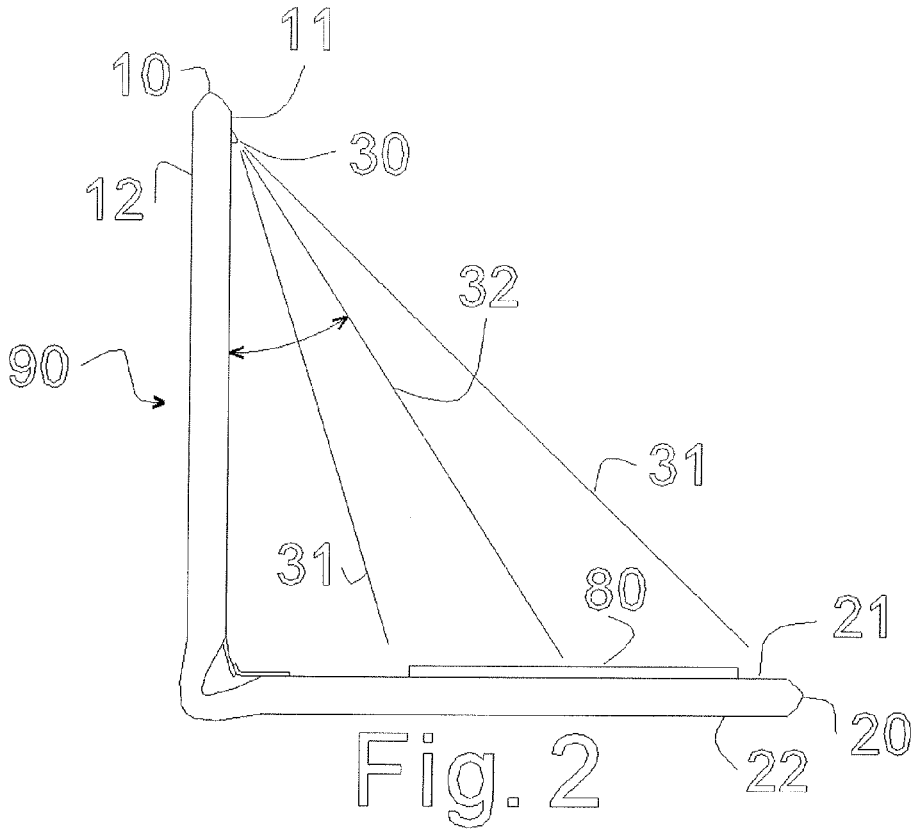
FIG. 2 is a side elevational view of a bill holder in a partially open position.

FIG. 2 illustrates a side view of a preferred embodiment of the Low Cost Automatically Illuminated Document Holder 90 of the present invention in a partially open position when front cover 10 is positioned ninety degrees from rear cover 20. Lamp 30 is mounted in cover 10 so that a centerline 32 of a cone of light 31 is at a maximum angle of thirty degrees to the front cover. This provides optimum illumination of the check by a low power LED which is required for non-replaceable batteries that enable a low cost illuminated bill holder.

The present invention thereby illuminates the bill with direct light at an angle of incidence ranging from 45 to 90 degrees. Prior art, as illustrated by U.S. Pat. No. 7,163,307 to Clark (2007) FIG. 3. discloses a very small angle of incidence which provides inefficient illumination and therefore requires a much higher power bulb to sufficiently illuminate a bill.

Furthermore prior art incorporating a very small angle of incidence shines harsh direct light over the bill and into the eyes of nearby customers. It will be evident after viewing the following figure that the angle of incidence of the present invention in combination with the energy-saving system prevents harsh direct light from striking the user's eyes or the eyes of nearby customers.

Figure 3:
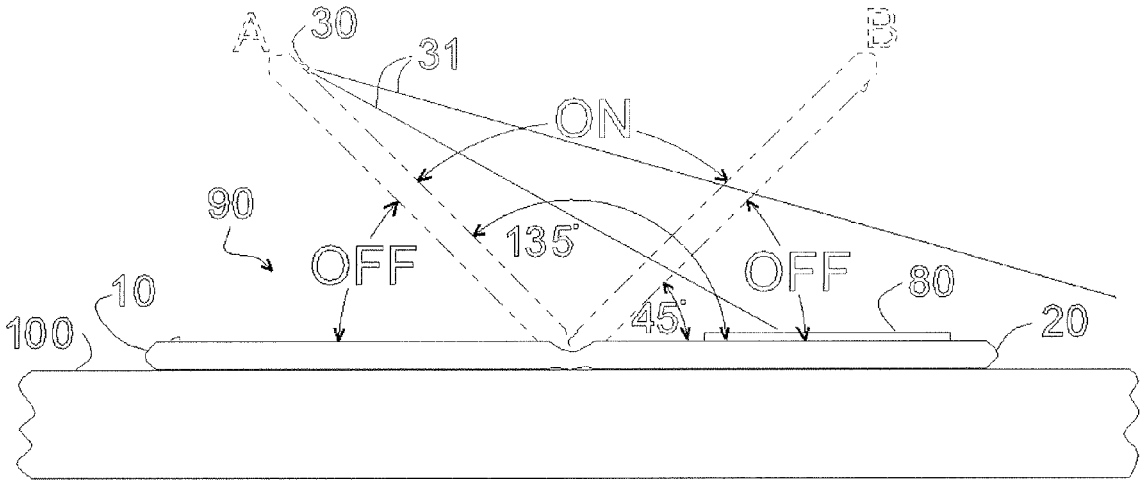
FIG. 3 is a side elevational view of a bill holder in the open position on a table.

FIG. 3 illustrates a side view of the preferred embodiment of a Low Cost Automatically Illuminated Document Holder 90 of the present invention in the fully open position on a table 100 when front cover 10 is positioned 180 degrees from rear cover 20. FIG. 3 illustrates the energy-saving system of the present invention. In the fully open position the lamp is off and remains off until front cover 10 is raised up to position B at which point it is 135 degrees from rear cover 20. This is the point at which the bulb becomes effective at illuminating bill 80 as the cone of light 31 moves onto the bill. When front cover 10 is in the position of 180 to 135 degrees from the rear cover, the cone of light does not sufficiently illuminate the bill and therefore wastes energy. In common usage, customers often leave the bill holder open and that can increase the daily battery drain by a factor of ten or more. In addition, if the bulb was on in that range, its light could have the negative effect of directly shining on the user or on nearby customers.

The energy-saving system of the present invention keeps the bulb on when front cover 10 is between position A and position B, where front cover 10 is forty five degrees from rear cover 20. At positions less than 45 degrees, the energy-saving system of the present invention turns the bulb off. This has the advantage of reducing battery drain at any position where it would be difficult for the user to view the bill or sign the bill. A further advantage is that it provides a substantial safety margin to ensure the bulb is off when the bill holder is closed. In common practice a pen is left between the covers and this can prevent the switch system of prior art auto-on bill holders from turning the bulb off. Additionally the present invention's energy saving system provides a safety margin for the adjustment of the switch. Ensuring the bulb is not on when the folder is closed is particularly critical because this could completely drain the battery within days.

Figure 4:
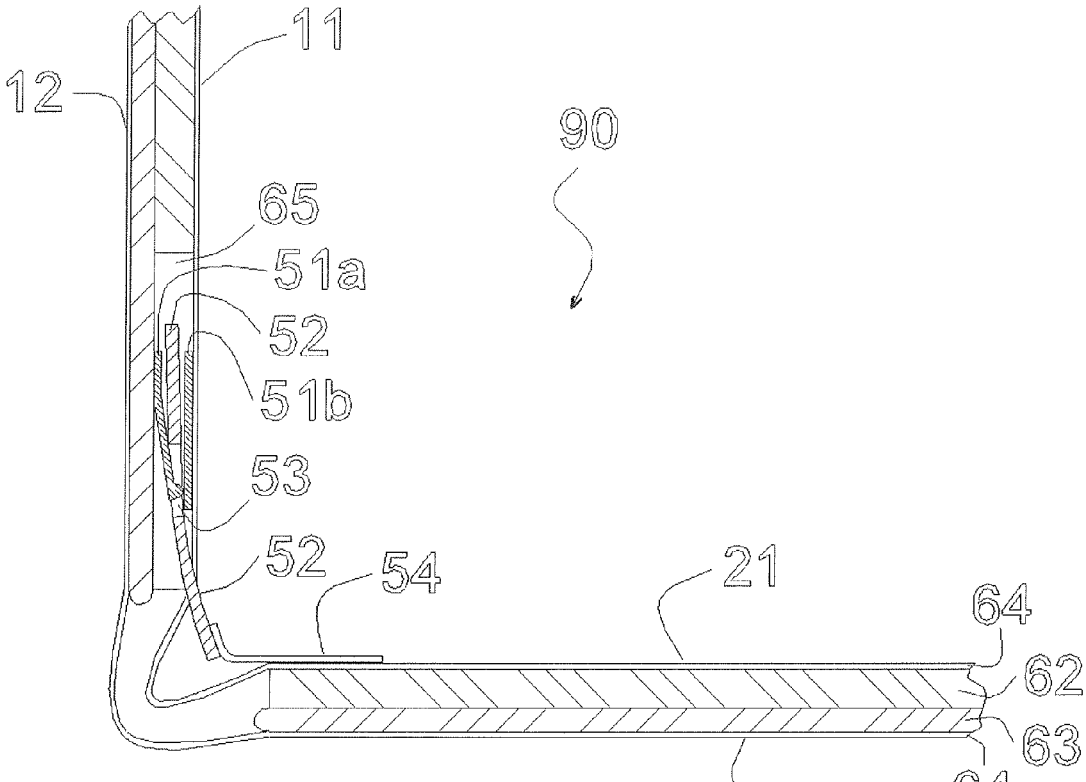
FIG. 4 is a side elevational view of a cross-section of the front and rear covers and switch of bill holder in a partially open position.

FIG. 4 illustrates a partial cross sectional side view of an inexpensive slide switch of a preferred embodiment of a Low Cost Automatically Illuminated Document Holder 90 holder in the partially open position. Insulator strip 52 slides between switch contact 51*a* and switch contact 51*b*. In the partially open position, an insulator slot 53 enables the contacts to touch and completes an electrical circuit to turn the bulb on. As front cover 10 is moved toward rear cover 20, insulator mount 54 pushes insulator slot away from contacts 51 and insulator strip 52 separates them. This turns the bulb off as the cover is closed. In a similar fashion, as front cover 10 is moved away from rear cover 20, insulator mount 54 pulls insulator slot 53 away from contacts 51 and separates them turning the bulb off as the bill holder is left open. Insulator strip 52 is comprised of a flexible plastic that is resilient and doesn't crease when bent as the folder is closed or opened past 180 degrees. The insulator mount is made of very flexible material such as a paper that can repeatedly bend 90 degrees or more with little resistance. The mount is typically joined to the insulator strip and rear cover by adhesive. In the preferred embodiment the switch is located in a backing material slot 65. A cover covering material 64 is comprised of one of the group of vinyl, leather and leather substitutes. A cover padding 63 may be made of foam and provides padding between a cover backing 62 and the cover material 64 on the outside surfaces.

Switch designs of this nature with a non-replaceable battery and light source are very inexpensive to manufacture and thereby help create an automatic illuminated bill holder that is competitive in price with normal bill holders. As example, greeting cards equipped with an automatic slide switch, battery, microchip and speaker that sing when opened are priced competitively, costing little more than other cards. The comparison of the competitive pricing of this type of card is valid with the present invention. The card's microchip and speaker cost even more than a LED. The present invention has numerous structural differences and advantages in operation over the card but these cost very little to execute.

Figure 5:
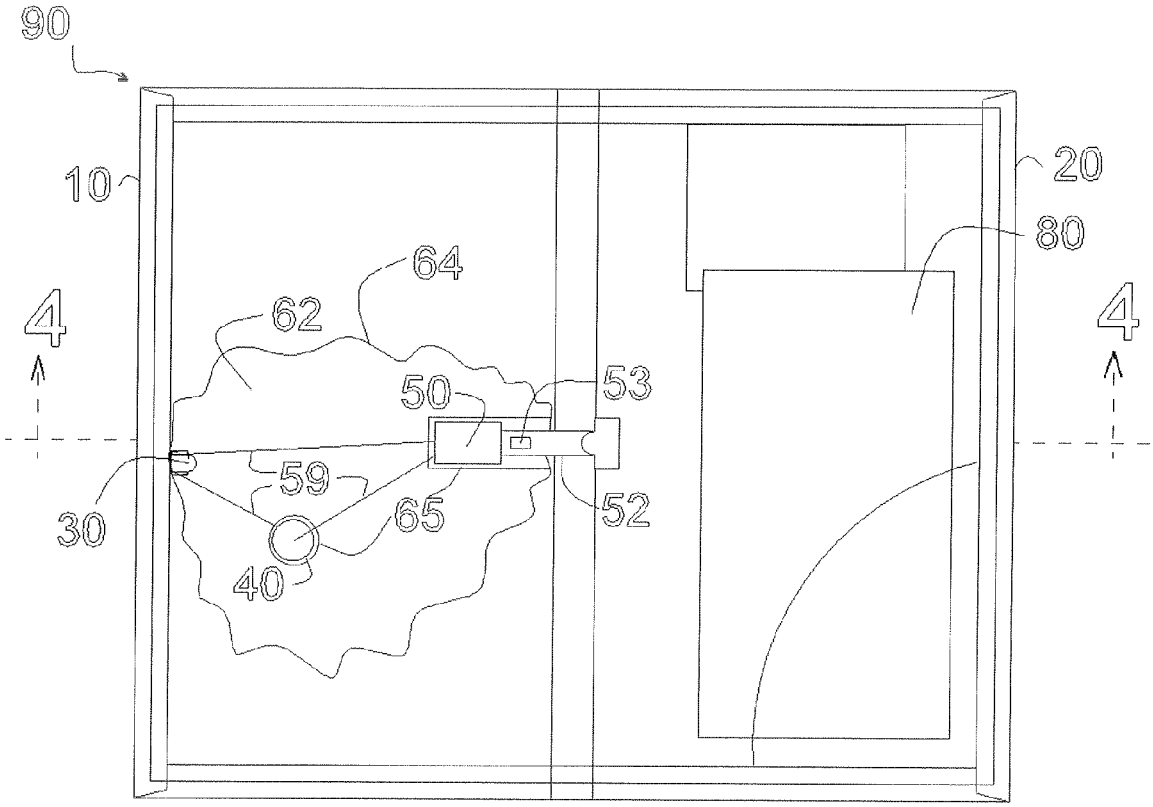
FIG. 5 is a top elevational view in partial cutaway of the inside front and rear covers, lamp, battery, and switch of a bill holder in the open position.

FIG. 5 is a partial cut-away top elevational view of the inside of a front cover 10, a lamp 30, a battery 40, a switch 50, wire 59 and rear cover 20 of an illustrative embodiment of the Low Cost Automatically Illuminated Document Holder 90 of the novel bill holder in the open position. Slots 65 are punched in a backing 62 for lamp 30, battery 40 and switch 50 so that the thickness of the front cover 10 is approximately the same as a standard bill holder that does not have these components. Wire 59 connects lamp 30, battery 40, and switch 50 in a series electrical circuit. The lamp, battery, and switch are shown mounted separately and connected with wire, however any or all may alternatively be mounted on a thin printed circuit board.

Figure 6:
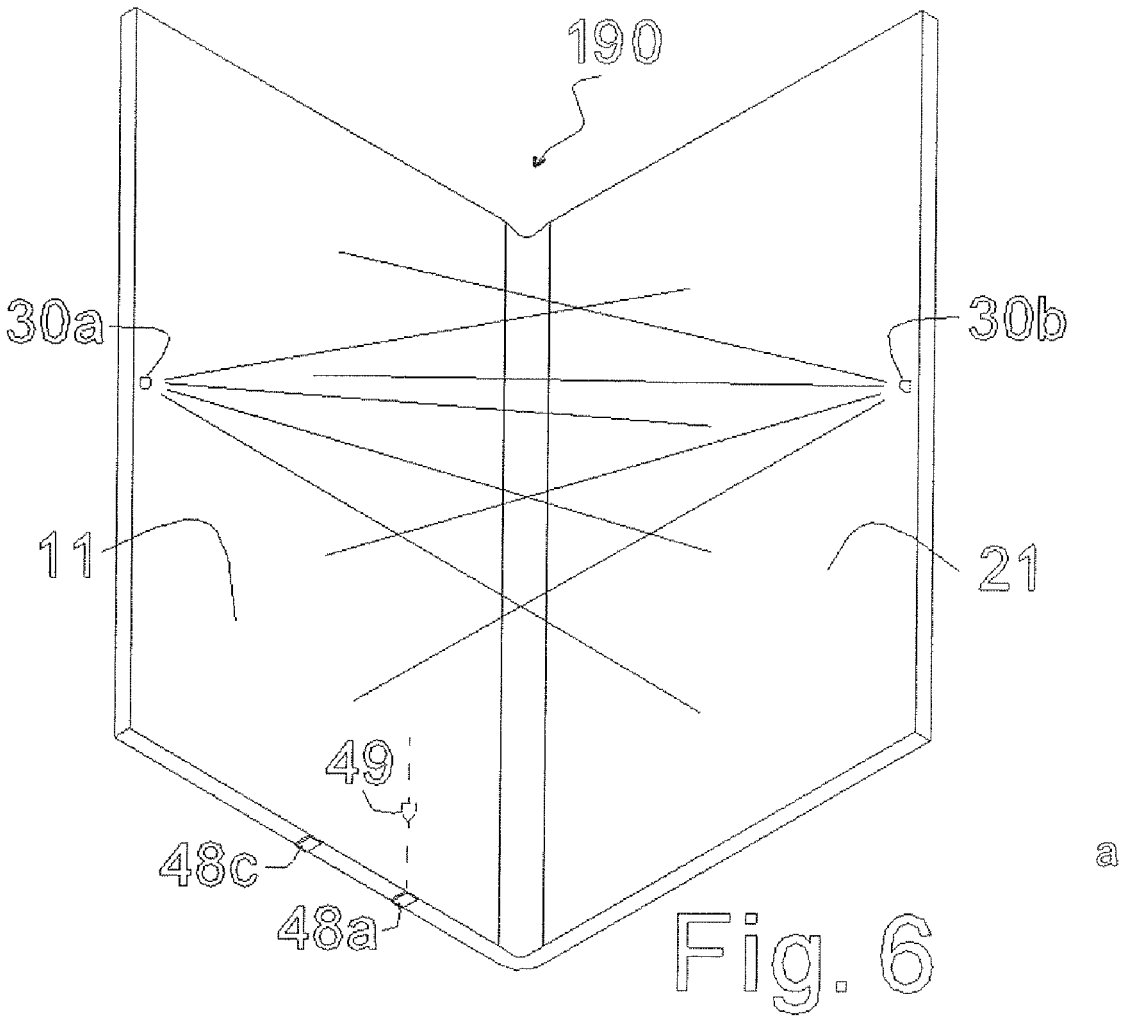
FIG. 6 is a perspective view of a menu holder in a partially open position.

FIG. 6 illustrates a second preferred embodiment of the present invention and illustrates a perspective view of a menu holder 190 of the Low Cost Automatically Illuminated Document Holder in a partially open position. Lamp 30*a* is mounted on a far edge of inside surface 11 of the front cover to illuminate inside surface 21 of the rear cover. Lamp 30*b* is mounted on a far edge of inside surface 21 of the rear cover to illuminate inside surface 11 of the front cover. A plurality of lamps may also be placed on the edges of the inside covers. The menu holder 190 has all the other components of the bill holder 90 and all of its objects and advantages.

A menu holder can require as much as four times the illumination of a bill holder because documents with text typically cover both top and bottom areas of two covers. In one embodiment, two or more charging contacts can be located on the external surface of either cover. One contact (48*c*) can be centered on the edge and another contact (48*a*) can be located a short distance away on the same edge.

In another embodiment, a safety diode (49) can be electrically connected in series to one battery terminal. The diode is orientated so that it allows electrical current to flow in the direction that charges the battery but prevents current flow in the opposite direction. The diode would therefore prevent current flow if the charging contacts where shorted out by silverware, coins or any other conductive materials on a table or in a storage area.

Figure 7:
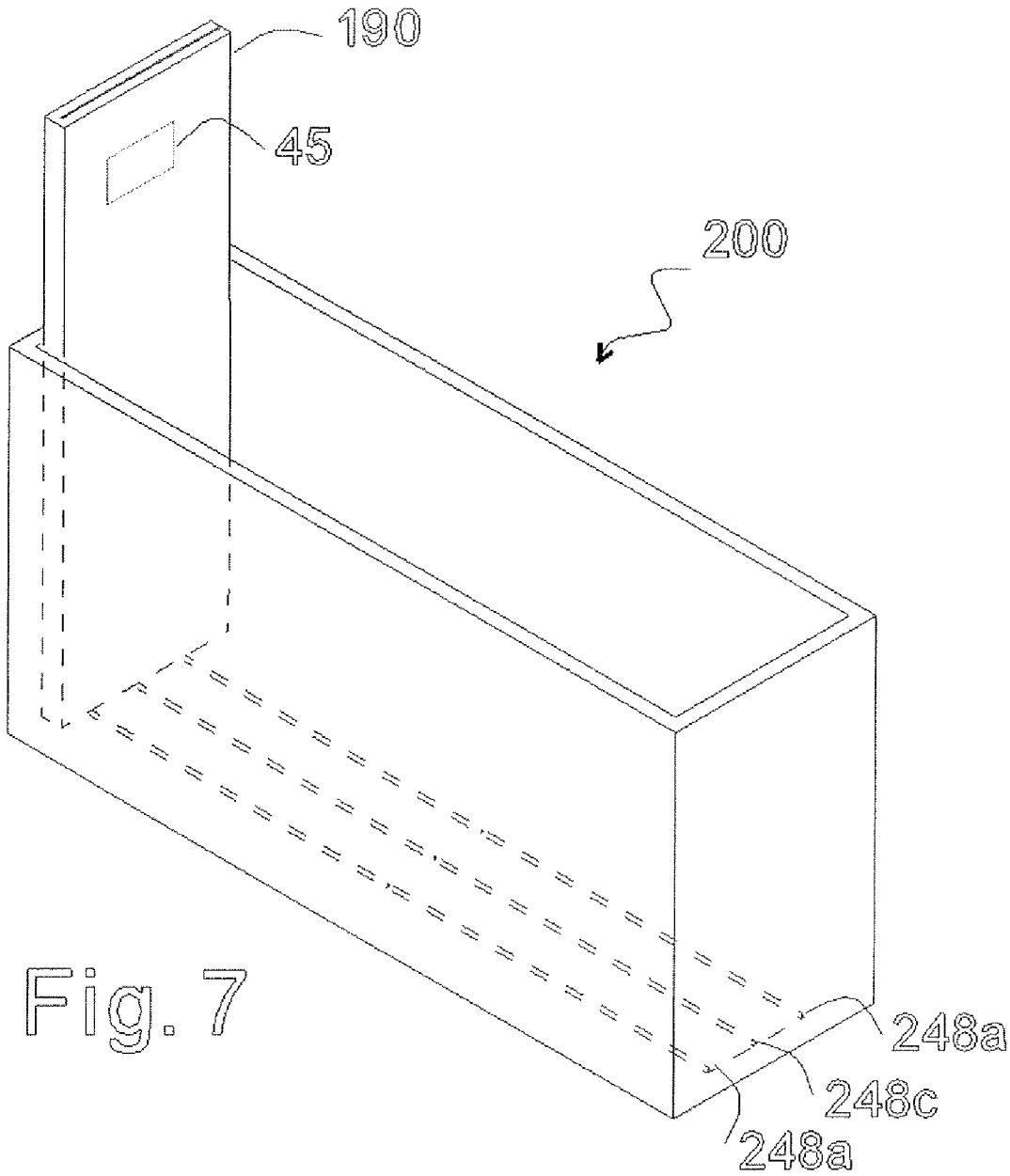
FIG. 7 is a perspective view of a menu holder in a recharging storage box.

FIG. 7 illustrates the second preferred embodiment of the present invention and illustrates a perspective view of menu holder 190 in a recharging storage box 200. The aforementioned contacts charge the battery by an external power supply (not shown) when menu holder 190 is stored upright in a row in box 200. The box can have two or more inexpensive rails, like model railroad tracks running longitudinally on the bottom of the box and connected to the power source. Placing the menu holder, contact-side down, in the box causes the contacts to be pressed against the rails to charge the battery automatically.

Center charging rail 248*c* can be run along the center of the storage box and be connected to one terminal of the external power supply. Two other rails 248*a* can be located a short distance from the center charging rail and be connected to the other terminal of the external power supply. With this arrangement of two contacts on the menu holder and three charging rails, the menu would contact the center charging rail and another charging rail and charge the battery without the restaurant employee having to note the position of the menu when it was placed in the storage box.

Alternately, three contacts can be placed on the menu, with one centered on the cover and the two other contacts placed a short distance from the center contact. The center contact can be connected to one battery terminal and the other two contacts connected to the other battery terminal. The arrangement of three contacts on the menu holder can enable the use of only two charging rails in the storage box to accomplish the same result as above.

In another embodiment, additional contacts can be placed on the opposite side of the menu cover in a similar position. This enables the menu holder to be charged when placed into the storage box in any of the four possible orientations.

Photoelectric panel 45 can be added to a cover and be electrically connected to the battery to recharge the battery at times when sufficient ambient illumination reaches the photoelectric panel.

The present invention discloses an illuminated bill holder that is low cost and competitive with standard bill holders in the market place. The energy-saving system of the present invention illuminates the bill only when the covers of the holder are in a position where the illumination would be useful. Furthermore, the system makes certain that wasteful battery drain does not occur when the holder is left open on a table or when the holder is prevented from being fully closed by a pen between its covers. The present invention's energy-saving system and its optimized lamp positioning extend battery life to the extent that the battery does not have to be replaced. Enabling the lamp, battery and switch to be permanently mounted within the cover of a standard padded bill holder creates very low cost manufacturing which is essential to be competitive with standard bill holders. It also enables the present invention to have similar appearance and the same dimensions as standard bill holders. The similar appearance and dimensions enables the present invention to easily integrate into the established bill holder distribution system and integrate into the end-user environment, the retail store or restaurant. An additional advantage is that the present invention is as easy to wipe clean as the standard bill holder.

This invention is clearly new and useful. Moreover, it was not obvious to those of ordinary skill in this art at the time it was made.

It will thus be seen that the objects set forth above, and those made apparent from the foregoing description, are efficiently attended. Since certain changes may be made in the foregoing construction without departing from the scope of the invention, it is intended that all matters contained in the foregoing construction or shown in the accompanying drawings shall be interpreted as illustrative and not in a limiting sense. As an example, the switch could be made of two separate switches wired in series. A normally open switch can turn the lamp on when the document holder is opened sufficiently, and a second normally closed switch could turn the lamp off when the document holder is opened substantially fully. Additional examples are the angle of the lamp and angular positions of the off-on-off energy savings systems.

It is also understood that the following claims are intended to cover all of the generic and specific features of the invention herein described, and all statements of the scope of the invention which, as a matter of language, might be said to fall there between.

What is claimed is:

1. A document holder comprising:

a) a first cover having an interior surface and an exterior surface;

b) a second opposing cover having an interior surface and an exterior surface;

c) a living hinge connecting said first cover and said second cover;

d) a lamp located on said interior surface of said first cover;

e) a battery located inside said first cover or said second cover;

f) a switch completing electrical connection between said battery and said lamp when said first cover is at a first range of angles to said second cover;

said switch interrupting electrical connection between said battery and said lamp when said first cover is at a second range of angles to said second cover; and said switch interrupting electrical connection between said battery and said lamp when said first cover is at a third range of angles to said second cover; and g) a conductive means whereby said lamp, said battery and said switch are electrically connected.

2. The document holder of claim 1, wherein said first range of angles is between 45 degrees and 135 degrees; said second range of angles is between 0 degrees and 45 degrees; and said third range of angles is greater than 135 degrees.

3. The document holder of claim 1, wherein said lamp is located on said interior surface of said front cover near an outer edge of said front cover opposite said living hinge.

4. The document holder of claim 3, wherein said lamp has a centerline of a cone of light that is a maximum of 30 degrees from said interior surface of said front cover.

5. The document holder of claim 1, wherein said lamp is a LED.

6. The document holder of claim 1, said switch comprising:

a) an insulator strip with a slot;

b) a plurality of electrical contacts; and c) said insulator strip attached to one of said covers.

7. The document holder of claim 1, said covers comprising:

a) a rigid backing material; and b) a cover material.

8. The document holder of claim 7, wherein said rigid backing material of said covers has a plurality of recesses whereby components from the list of said battery, said lamp, said switch and said conductive means are enclosed within said rigid backing material.

9. The document holder of claim 7, wherein said covers have a padding material between said rigid backing material and said cover material.

10. The document holder of claim 3, wherein said lamp is located in a range from a midpoint of said edge to a bottom point of said edge.

11. The document holder of claim 1, wherein said covers are rectangular.

12. The document holder of claim 1, wherein said covers have indicia whereby a company name, a company logo or a credit card logo is visible.

13. The document holder of claim 1, wherein a photoelectric panel is on said front cover or said rear cover and electrically connected to said battery whereby said battery is recharged when sufficient ambient illumination reaches said photoelectric panel.

14. A document holder comprising:

a) a first cover having an interior surface and an exterior surface;

b) a second opposing cover having an interior surface and an exterior surface;

c) a living hinge connecting said first cover and said second cover;

d) a plurality of lamps located on said interior surfaces of said covers;

e) a battery located inside said first cover or said second cover;

f) a switch completing electrical connection between said battery and said lamp when said first cover is at a first range of angles to said second cover;

said switch interrupting electrical connection between said battery and said lamp when said first cover is at a second range of angles to said second cover; and said switch interrupting electrical connection between said battery and said lamp when said first cover is at a third range of angles to said second cover; and g) a conductive means whereby said lamp, said battery and said switch are electrically connected.

15. The document holder of claim 14, wherein said first range of angles is between 45 degrees and 135 degrees; said second range of angles is between 0 degrees and 45 degrees; and said third range of angles is greater than 135 degrees.

16. The document holder of claim 14, wherein said lamps are located on said interior surfaces of said covers near an outer edge of said covers opposite said living hinge.

17. The document holder of claim 16, wherein said lamps have a centerline of a cone of light that is a maximum of 30 degrees from said interior surface of said front cover on which said lamps are located.

18. The document holder of claim 14, wherein two or more contacts are on said exterior surfaces of said covers and wherein conductive means electrically connect said contacts with said battery whereby said battery can be recharged.

19. A method of automatically providing additional illumination to a document in a low cost document holder having a front cover and a rear cover comprising the steps of:

a) providing a document holding having a front cover and a rear cover;

b) opening said document holder covers to the range of 45 degrees to 135 degrees wherein a document is provided with said additional illumination when said additional illumination is desired for reading said document;

c) opening said document holder covers to a range of over 135 degrees wherein said additional illumination is not provided when said additional illumination is not desired for reading said document; and d) closing said document holder covers to a range of less than 45 degrees wherein said additional illumination is not provided when said additional illumination is not desired for reading said document.

* * * * *